United States Patent [19]

Tomita

[11] 4,332,101

[45] Jun. 1, 1982

[54] TOY KITCHEN ASSEMBLY

[75] Inventor: Tohru Tomita, Tokyo, Japan

[73] Assignee: Takara Co., Ltd., Tokyo, Japan

[21] Appl. No.: 228,478

[22] Filed: Jan. 26, 1981

[30] Foreign Application Priority Data

Jan. 30, 1980 [JP] Japan ..... 55-10080

[51] Int. Cl.[3] ..... A63H 33/28; A63H 3/52

[52] U.S. Cl. ..... 46/9; 46/14; 46/248; 46/44; 40/406

[58] Field of Search ..... 46/9, 14, 15, 44, 248; 40/406, 407, 409, 538

[56] References Cited

U.S. PATENT DOCUMENTS

| | | |
|---|---|---|
| 1,068,875 | 7/1913 | Fielding . |
| 1,080,340 | 12/1913 | Heissenbuttel . |
| 1,603,664 | 10/1926 | Coventry . |
| 1,633,313 | 6/1927 | Carter et al. . |
| 1,822,511 | 9/1931 | Stone et al. . |
| 2,198,177 | 4/1940 | Pohlhaus . |
| 2,279,113 | 4/1942 | Dudek . |
| 3,078,607 | 2/1963 | Butler et al. . |
| 3,133,376 | 5/1964 | Orenstein . |
| 3,154,881 | 11/1964 | Elwell . |
| 3,205,610 | 9/1965 | Palumbo et al. . |
| 3,342,746 | 9/1967 | Seuthe . |
| 3,831,314 | 8/1974 | Bass et al. . |
| 3,846,933 | 11/1974 | Hill et al. . |
| 3,998,001 | 12/1976 | Meyer et al. . |

*Primary Examiner*—F. Barry Shay

*Attorney, Agent, or Firm*—Jackson, Jones & Price

[57] ABSTRACT

A toy stove assembly includes a housing member configured to simulate a stove with an upper burner portion. A cooking vessel has an apertured false bottom connected to a conduit that extends to the exterior of the cooking vessel. Pressurized air is generated and connected to the conduit so that the air can be introduced into the cooking vessel to simulate boiling of any liquid substance in the cooking vessel. A toy kitchen sink can also optionally be included with the same motor that provides the pressurized air providing a pumping action for delivering water through a faucet.

22 Claims, 3 Drawing Figures

FIG. 2
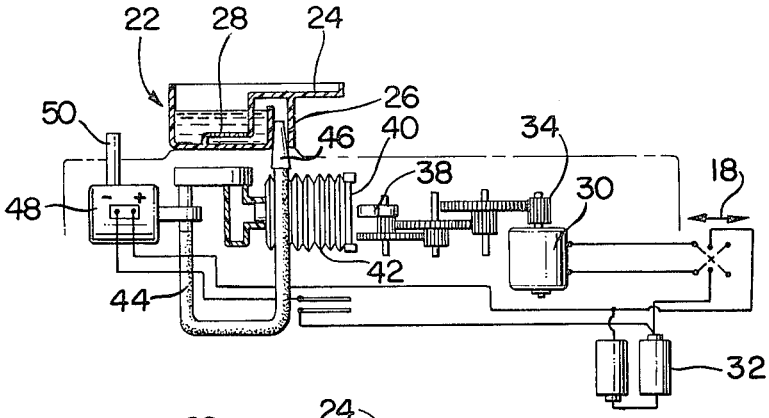
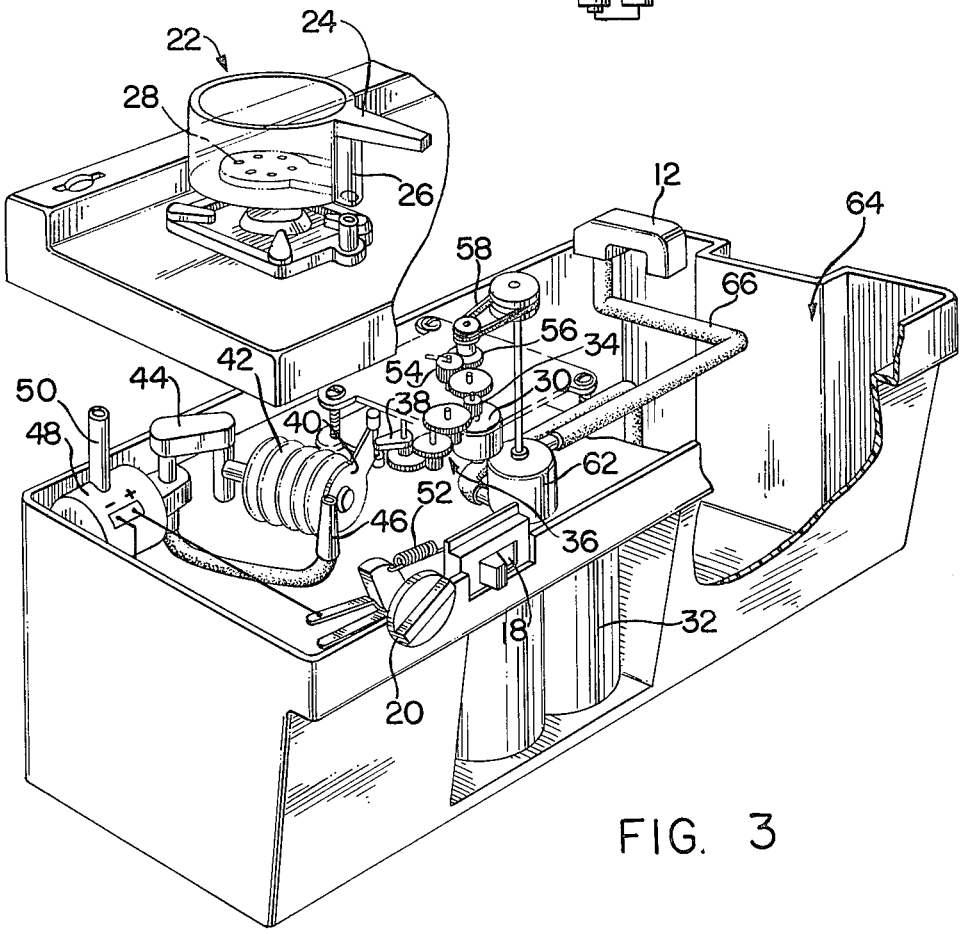
FIG. 3

TOY KITCHEN ASSEMBLY

BACKGROUND OF THE INVENTION

1. Field of the Invention

The present invention is directed to a simulated toy kitchen apparatus and more particularly, to a miniaturized toy stove capable of simulating a cooking procedure.

2. Description of the Prior Art

Numerous forms of children's toy furniture and doll houses have provided toy kitchens. For example, a separate modular toy kitchen and sink have been provided in the prior art with the sink capable of functioning to dispense water.

An example of a toy oven that actually cooks food can be found in U.S. Pat. No. 3,368,063.

The desirability of providing a simulated kitchen assembly that can create the illusion of a fully functioning kitchen for a young child in a safe and economical manner is still an object of the prior art.

SUMMARY OF THE INVENTION

The present invention provides a toy stove assembly capable of simulating the cooking of food. A housing member is configured to simulate a stove having at least one upper burner portion. Cooking vessels are provided having U-shaped air conduits extending from the interior of the cooking vessel to the exterior. Preferably, the cooking vessel has a false apertured bottom for communication with the air conduit. A male coupling member can be provided adjacent the upper burner portion for connection to the exterior portion of the conduit on the side of the cooking vessel. A flexible bellows and a driving motor are mounted within the housing member. Pressurized air from the bellows is provided to the male coupling member. If the cooking vessel has water covering the apertured bottom, then the introduction of the pressurized air into the false bottom of the cooking vessel will create the illusion of boiling water with bubbles of pressurized air.

An additional feature of the present invention is its capability to produce smoke for optional introduction into the pressurized air. This is accomplished by providing a heating element within a receptable that receives cooking oil. The cooking oil is heated to a temperature which produces smoke that can be subsequently safely introduced into the air pressure to give the illusion of white steam or cooking smoke resulting from the actual cooking of food in the cooking vessel.

Finally, the motor that drives the air bellows can further drive a water pump that is connected to the water faucet on a kitchen sink for optionally dispensing water into the kitchen sink while at the same time creating the illusion of cooking food.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

BRIEF DESCRIPTION OF THE DRAWINGS

FIG. 2 is a schematic cross sectional view of the present invention, and

FIG. 3 is a partial schematic exploded perspective view of the present invention.

DESCRIPTION OF THE PREFERRED EMBODIMENT

Figure 1:
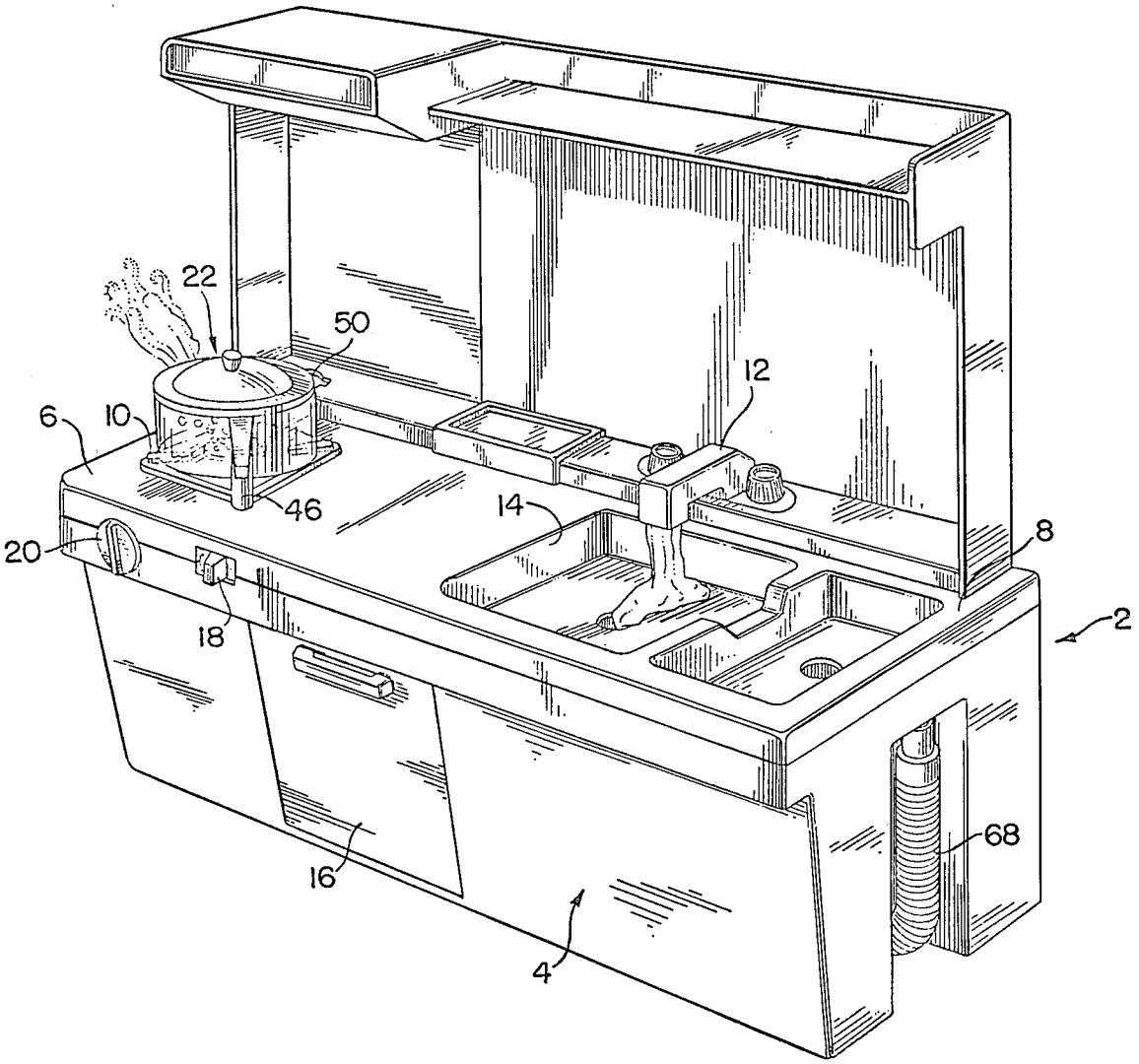
FIG. 1 is a perspective view of the toy kitchen assembly of the present invention.

The following specification, taken in conjunction with the drawings, sets forth the preferred embodiment of the present invention. The embodiment of the invention disclosed herein is the best mode contemplated by the inventor for carrying out his invention in the commercial toy environment, although it should be understood that various modifications can be accomplished within the parameters of the present invention.

Referring to FIG. 1, a perspective view of the toy kitchen assembly 2 of the present invention is disclosed. A housing member 4 has a first portion 6 configured to simulate a stove. While it should be appreciated that the actual configuration of the stove can be as varied as the modern stoves that are commercially available, such as gas burners, electric burners, ceramic heating grills, inductive heaters, microwave ovens, etc., the configuration of the embodiment disclosed herein would be conventionally associated with a gas burner and stove combination. Thus, at least one raised surface having a configuration of a burner grill portion 10 is provided on the top surface of the housing member 4. Additional burners can be provided, either having the play action feature of the present invention, or simply simulating a burner array. As with most modern toys, it is highly preferable that the housing member and each of the component parts forming the structure of the housing member be molded from a plastic material. A second portion 8 of the housing member 4 simulates a kitchen sink complete with an active faucet 12 capable of dispensing water into the basin of the sink 14. A battery storage compartment 16 and respective controls 18 and 20 are provided on the front portion of the housing member 4.

Referring to FIGS. 2 and 3, a cooking vessel 22, for example in the configuration of a pot, can be mounted on the burner portion 10. The cooking vessel is preferably formed from a transparent methyl methacrylate or polystyrene material and includes a conventional handle 24. Extending down beneath the handle 24 is a conduit 26 that provides a conduit from the exterior of the cooking vessel 22 into the interior. This conduit 26 has a U-shaped configuration and communicates with an apertured disc-shaped cavity 28 that forms a false bottom for the interior of the cooking vessel 22.

Mounted within the housing member 4 is a bi-directional D.C. motor 30 of a conventional type that can be appropriately connected to a source of power, such as batteries 32 positioned in the battery storage compartment 16. The control switch 18 is a two-way throw double-pull switch to permit a reversing of polarity of power to the D.C. motor 30. Thus, the drive gear 34 mounted on the output shaft of the motor 30 can rotate in a clockwise or counterclockwise direction, depending on the position of the switch 18. The gear power train 36 is connected to an elliptical cam member 38 that is capable of pivotally rotating a follower lever 40 against a resilient bellows member 42, to produce a reciprocating contraction and expansion of the bellows 42 for creating air pressure through conduit 44. Conduit 44 terminates in a male coupling member 46 that extends above the upper surface of the housing member 4 adjacent the burner portion 10. The male coupler 46 is configured to be complementary to the ported opening of the conduit 26 beneath the handle 24 of the cooking vessel 22. As can be readily appreciated, the cooking vessel 22 can take many forms or configurations, e.g., frying pan, teapot, etc., and each of the respective apertured openings will be complementary to the male coupler 46.

Thus, activating the control switch 18, in either direction, will power the D.C. motor 30 to drive the gear reduction train 36 to couple the output of the motor shaft for eventual application to the follower lever 40 through the elliptical cam member 38. The relative positioning of the pivotal follower lever 40 and the elliptical cam member 38 is such that an air pumping action is provided to the bellows 42 irregardless of the direction of rotation of the elliptical cam member 38. Thus, an air pump assembly is provided for introducing pressurized air through the conduit 44 to a delivery port on the male coupler 46. By appropriately positioning the cooking vessel 22 so that its exterior conduit portion 26 fits over the male coupler 26, pressurized air can then be delivered through the apertures of the cavity 28. It is generally expected that the child will use water as shown in FIG. 2 and by providing a transparent cooking vessel 22, the child can perceive visually the air bubbles rising from the bottom of the cooking vessel 22 to the surface of the water. The U-shaped conduit 26 prevents any leakage of water from the cooking vessel.

As an additional feature of the present invention, a heat insulated receptacle 48 is provided with a heater element to form a burner assembly to produce smoke. A spout 50 communicates with the receptacle 48 and extends upward through a ledge portion adjacent the upper surface of the housing member 4. Conventional cooking oil can be introduced, for example, through an eye dropper, into the spout 50 and activation of the control switch 20 will heat the oil to a temperature to produce vapors or smoke. The vapors or smoke can be drawn into the air conduit 44 by means of a conventional venturi connection (not shown) for eventual introduction into the cooking vessel 22. The mixing of the whitish smoke with the pressurized air creates an additional realistic appearance of actually cooking food, such as boiling a liquid, to the child. The switch 20 is connected to a spring 52 to bias it to an open position. This is a safety feature to ensure that the activation of the heater element only occurs while the knob of the control 20 is physically held and turned counterclockwise against the spring bias to close the circuit and activate the heating element.

The final feature of the invention provides a combination kitchen assembly with a capacity to dispense water through the faucet 12. A variably positioned pinion gear has a central axle that is freely cam mounted to permit the pinion gear to provide a driving connection to the gear power train 36 with a second drive gear 56 when it rotates in one direction. When the pinion gear rotates in the other direction, it disengages from the drive gear 56 and merely rotates as an idler gear. The second drive gear 56 is connected via a belt and pulley assembly 58 to and drives a power shaft 60. The power shaft 60 in turn drives a water pump 62 which is connected to a sump 64 beneath the basin of the sink 14. The output conduit 66 is connected to the faucet 12. A flexible hose 68 is mounted on the exterior of the housing member 4 and permits the drainage of the water from the sump 64 at the termination of play.

In operation, the child simply throws the control switch 18 to the right to cause the motor 30 to be connected through the drive pinion gear 54 with the second drive gear 56. The output of the drive gear 56 is transmitted via the belt and pulley assembly 58 to the power shaft 60 and then to the water pump 62. Water is thereafter transmitted to the faucet 12 for discharge into the basin 14. The child can fill the sump 64 by simply pouring water from any external source into the basin 14. When he is done playing he can position the flexible hose 68 below the level of the sump 64 and drain the water from the toy kitchen assembly 2. Since the gear power train 36 and the elliptical cam member 38 effectively work in either direction of rotational output from the D.C. motor 30, the cooking action continues when the child wishes to activate the switch 18 to provide water from the faucet 12. As can be appreciated, the pumping of the water is an optional additional feature that can be driven off the same D.C. motor 30.

Thus, a child is provided with the capability of enjoying a simulated functioning of a toy kitchen assembly in a safe and interesting format. The child can place a cooking vessel 22 onto the burner portion 10 of the stove, preferably filled with water, and can activate the control switch 18 by moving it in a leftward direction to force pressurized air into the cooking vessel and to simulate the boiling of a liquid. Movement of the switch 18 in the right direction will continue the cooking action while also permitting water to be pumped through the faucet 12. The child can further heighten the sensation of cooking by holding the switch 20 closed in a counterclockwise direction to activate a heating element. The heating element will in turn produce smoke from conventional cooking oil and introduce it into the air conduit 44 for delivery to the cooking vessel 22.

As can be readily appreciated, various modifications are possible within the scope of the present invention by a person skilled in the toy industry, and accordingly, the present invention should be measured solely from the following claims, wherein:

I claim:

1. A toy stove assembly capable of simulating the cooking of food comprising:

a housing member configured to simulate a stove and a kitchen sink;

first means in the housing member to simulate at least one area for placing a cooking vessel, said first means including means for introducing pressurized air into the cooking vessel to simulate boiling of a liquid substance in the cooking vessel;

a member attached to the housing member and configured to simulate a faucet, and means in said housing for pumping a liquid such as water into the faucet simulating member wherefrom the liquid pours into the sink, the means for pumping also including means connected thereto in said housing for continuously circulating the liquid from the sink into the faucet.

2. The invention of claim 1 further including the cooking vessel and wherein the means for introducing pressurized air includes an air passage extending into an interior bottom of the cooking vessel.

3. The invention of claim 2 wherein the cooking vessel includes an inverted U-shaped conduit in the air passage and an apertured bottom surface connected to the conduit.

4. The invention of claim 2 wherein the means for introducing pressurized air includes an air pump assembly and a delivery port adjacent the cooking area of the cooking vessel and connected to the air pump assembly.

5. The invention of claim 2 further including means for producing smoke operatively connected to the cooking vessel to introduce smoke onto the cooking vessel, the means for producing smoke being controllable separately from the means for introducing pressurized air, and from the means for pumping.

6. The invention of claim 5 wherein the means for producing smoke includes a heating element to heat cooking oil to a temperature to produce smoke, the heating element being controlled by a switch spring-biased into an open position whereby positive action by a player is required to activate the means for producing smoke.

7. The invention of claim 1 wherein the means for introducing pressurized air further includes a motor assembly and an air bellows connected to the motor assembly.

8. The invention of claim 6 wherein the motor assembly includes a battery-driven electric motor capable of rotating in either clockwise or counterclockwise direction at the option of a player; the motor being permanently coupled through a first gear train to drive the air bellows regardless of the direction of rotation of the motor, the motor also being coupled by a second gear train to drive the means for pumping only when the motor rotates in one of the two directions whereby the player at his option may activate the means for pumping simultaneously with the means for introducing pressurized air.

9. The invention of claim 8 wherein the second gear train includes a variably positionable pinion gear adapted for operative coupling to a rotating shaft driven by the motor only when the motor rotates in one of the two directions.

10. The invention of claim 9 wherein the means for pumping includes a water pump driven by the motor through the rotating shaft and the second gear train.

11. The invention of claim 1 wherein the first means for simulating at least one area for placing a cooking vessel in a raised support member.

12. A toy kitchen assembly comprising:

a first housing member configured to simulate a stove and having an upper surface;

at least one cooking vessel;

first means on the first housing member including means for simulating at least one area in the upper surface for placing the cooking vessel and including means for introducing pressurized air into the cooking vessel to simulate boiling of a liquid substance in the cooking vessel;

a second housing member attached to the first housing member and configured to simulate a kitchen sink, and means operatively associated with the sink for storing water in a sump and for introducing water into the sink from the sump, said means for storing and introducing water including a control switch.

13. The invention of claim 12 further including means for producing smoke and to introduce the smoke into the cooking vessel.

14. The invention of claim 12 wherein the means for introducing pressurized air includes an air passage male coupling member extending into the interior bottom of the cooking vessel.

15. The invention of claim 14 wherein the cooking vessel includes an inverted U-shaped conduit connectable to the air passage male coupling member and an apertured bottom surface connected to the conduit.

16. The invention of claim 14 wherein the means for introducing pressurized air includes an air pump assembly connected to the air passage male coupling member.

17. The invention of claim 12 wherein the means for introducing pressurized air includes a battery driven electric motor having a rotating output shaft, a first gear train permanently coupled with the output shaft, and means for blowing air permanently coupled with and driven by the first gear train regardless of a direction of rotation of the output shaft: and wherein the means for storing and introducing water includes a second gear train and a water pump operatively coupled with the second gear train and driven thereby, and wherein the control switch includes means for activating the electric motor and controlling the direction of rotation of the electric motor at the option of a player, the second gear train being operatively coupled to the rotating shaft only when the electric motor rotates in one predetermined direction, whereby a player may, at his option, activate the means for storing and introducing water simultaneously with the means for introducing pressurized air.

18. The invention of claim 17 wherein the means for blowing air is a bellows assembly.

19. A toy stove assembly capable of simulating the cooking of food, comprising:

a housing member configured to simulate a stove having at least one upper burner portion;

at least one cooking vessel having a first conduit extending from the interior of the vessel to the exterior;

connection means on said member adjacent the upper burner portion, for connection with the first conduit;

means for producing pressurized air including a second conduit for connection with the connection means whereby pressurized air is introduced into the cooking vessel to simulate boiling of a liquid substance in the cooking vessel, and means for producing smoke connected to the second conduit to introduce smoke into the cooking vessel.

20. The invention of claim 19 wherein the first conduit of the cooking vessel is an inverted U-shaped conduit and wherein the cooking vessel includes an apertured bottom surface connected to the first conduit.

21. The invention of claim 19 wherein the means for producing smoke includes a heating element to heat cooking oil to a temperature to produce smoke.

22. The invention of claim 19 wherein the means for producing pressurized air further includes a motor assembly and an air bellows connected to the motor assembly.

* * * * *